US009032751B2

(12) United States Patent
Lacey et al.

(10) Patent No.: US 9,032,751 B2
(45) Date of Patent: May 19, 2015

(54) ADAPTIVE DEFROST CONTROLLER FOR A REFRIGERATION DEVICE

(75) Inventors: Kevin Lacey, Oak Park, IL (US); Robert Alvord, Elmwood Park, IL (US); Jim Kopec, St. Charles, IL (US)

(73) Assignee: Diehl AKO Stiftung & Co. KG, Wangen (DE)

( * ) Notice: Subject to any disclaimer, the term of this patent is extended or adjusted under 35 U.S.C. 154(b) by 1410 days.

(21) Appl. No.: 12/603,189

(22) Filed: Oct. 21, 2009

(65) Prior Publication Data

US 2011/0088415 A1 Apr. 21, 2011

(51) Int. Cl.

*F28D 21/00* (2006.01)
*F25D 21/00* (2006.01)
*F25B 47/02* (2006.01)

(52) U.S. Cl.

CPC ..... *F25D 21/006* (2013.01); *F25B 47/02* (2013.01); *F25B 2700/11* (2013.01); *F25D 2600/02* (2013.01); *F25D 2700/122* (2013.01); *F25D 2700/123* (2013.01); *F25D 2700/14* (2013.01)

(58) Field of Classification Search

CPC ... F25D 21/002; F25D 21/004; F25D 21/008; F25D 21/00; F24F 2013/22; F25B 47/02
USPC ..... 62/234, 80, 272, 151, 154, 155, 156
See application file for complete search history.

(56) References Cited

U.S. PATENT DOCUMENTS 4,327,557 A * 5/1982 Clarke et al. ..... 62/234
4,481,785 A 11/1984 Tershak et al.
4,627,245 A * 12/1986 Levine ..... 62/234
4,680,940 A * 7/1987 Vaughn ..... 62/234
4,750,332 A * 6/1988 Jenski et al. ..... 62/155
4,751,825 A * 6/1988 Voorhis et al. ..... 62/234
4,850,204 A * 7/1989 Bos et al. ..... 62/234
4,938,027 A * 7/1990 Midlang ..... 62/156
4,993,233 A * 2/1991 Borton et al. ..... 62/155
5,231,844 A 8/1993 Park
5,363,669 A * 11/1994 Janke et al. ..... 62/155
5,415,005 A * 5/1995 Sterber et al. ..... 62/154
5,440,893 A * 8/1995 Davis et al. ..... 62/155
5,469,715 A * 11/1995 Janke et al. ..... 62/155
5,483,804 A 1/1996 Ogawa et al.
5,493,867 A * 2/1996 Szynal et al. ..... 62/80
5,515,692 A 5/1996 Sterber et al.
5,553,349 A 9/1996 Kilstrom et al.
6,497,108 B2 * 12/2002 Collins et al. ..... 62/155
6,523,358 B2 * 2/2003 Collins ..... 62/156
6,715,304 B1 * 4/2004 Wycoff ..... 62/155

(Continued)

FOREIGN PATENT DOCUMENTS

EP 1731859 A2 12/2006

*Primary Examiner* — Ljiljana Ciric

(74) *Attorney, Agent, or Firm* — Laurence A. Greenberg; Werner H. Stemer; Ralph E. Locher

(57) ABSTRACT

A system and method for controlling automatic defrost of a refrigerator device adaptively moves the defrost cycle to a time period of comparatively low compressor activity based on an evaluation of compressor usage over a cyclically recurring time interval. An adaptive defrost controller (ADC) analyzes stored data to develop a profile for compressor activity vs. time. From this profile, high compressor activity times of the time interval are distinguished from low compressor activity times in the time interval and a defrost cycle is scheduled based on the results of the analyzed data.

25 Claims, 5 Drawing Sheets

(56) References Cited

U.S. PATENT DOCUMENTS

| | | | | |
|---|---|---|---|---|
| 6,739,146 | B1 * | 5/2004 | Davis et al. | 62/155 |
| 6,772,597 | B1 * | 8/2004 | Zentner et al. | 62/80 |
| 6,837,060 | B2 * | 1/2005 | Collins | 62/156 |
| 6,851,270 | B2 * | 2/2005 | Denvir | 62/234 |
| 7,716,937 | B2 * | 5/2010 | Schenk et al. | 62/155 |
| 7,921,660 | B2 * | 4/2011 | Brody | 62/155 |
| 7,942,014 | B2 * | 5/2011 | Rafalovich et al. | 62/155 |

* cited by examiner

ADAPTIVE DEFROST CONTROLLER FOR A REFRIGERATION DEVICE

FIELD OF THE INVENTION

The instant invention relates to a defrost controller for a refrigeration device, and more particularly, to a defrost controller that adaptively schedules a defrost cycle at low energy cost times without using any real "time-of-day" clock function.

DESCRIPTION OF THE RELATED ART

Refrigerators today typically perform a "defrost cycle" to melt the ice or frost that forms on the evaporator of the appliance. The operation of such a defrost cycle consumes a lot of power and, additionally, causes the refrigerator's compressor to run for a longer than normal period, to return the appliance to its desired internal temperature. Typical data shows that the defrost and recovery periods of operation of the refrigerator use two to four times the average energy used at other times during the refrigerator operation. As such, attempts have been made to optimize the time in which defrost occurs, to adapt to lower energy cost/usage times of day.

Different refrigerator mechanisms have been employed to determine a low energy cost and/or low usage time of day in which to perform a defrost cycle. For example, European Patent Publication No. EP1 731 859 A2 discloses controlling the defrosting of a refrigerator using a light signal received by a sensor, wherein the signal is evaluated in such a way that ambient night illumination conditions can be detected, in which case, defrosting is initiated. European Patent Publication No. EP 1 496 324 A1 uses an external clock to schedule defrost time at night.

Additionally, although not disclosed in connection with scheduling a defrost cycle, U.S. Pat. No. 5,533,349 (the "'349 patent") discloses a device, such as a microcontroller, utilized to monitor the operation of a refrigerator compressor based on readings of a temperature sensor, with initial reference times being stored in the microcontroller. The microcontroller of the '349 patent keeps track of the times it takes for the inside temperatures to change between the turn on and turn off temperatures and can also determine the slope temperature between the turn on and turn off temperatures. Then, in the '349 patent, the present time conditions are compared to reference times to calculate the temperature outside the enclosure and, using this information, the operation of the compressor may be adjusted based on the estimated or concluded outside temperature.

Certain other systems tie the defrost cycle to the opening of the refrigerator doors. For example, U.S. Pat. No. 5,231,844 discloses a controller that starts a defrost operation when the requirements for the defrost time, the temperatures of the freezing compartment and the refrigerating compartment and the position of the doors are simultaneously satisfied.

U.S. Pat. No. 5,483,804 (the "'804 patent") discloses a defrost control apparatus for a refrigerator that includes a microcomputer which counts the number of opening/closing times of a door of a storage room for each of time zones within a day so as to set indexes for every time zones on the basis of the number of opening/closing times. In accordance with the indexes, a defrost on/off signal is generated by defrost signal generating means such that a defrost operation can be performed in a time zone wherein a frequency of the opening/closing of the door is small. The microcomputer also counts operating hours of a compressor and total elapsed hours, and determines a sudden phenomenon and a season. Thus, the system of the '804 patent performs the defrost in "time zones" when the frequency of door opening is small, which could be at high energy cost times (i.e., at mid-day), rather than at low energy cost times (i.e., at night). Additionally, the complex calculation of indices in the '804 patent are more intensive than can be performed by a small general purpose microcontroller. See also, for example, U.S. Pat. No. 6,523,358.

U.S. Pat. No. 5,515,692 (the "'692 patent") discloses a device and method for automatically defrosting a refrigeration system, which includes a microprocessor that initiates a defrost cycle during a time of day that is most efficient for the refrigerator and the utility company. The '692 patent further discloses that the defrost cycle is initiated during a time of day that has the least impact on stored food. In particular, the '692 patent discloses a microprocessor programmed to analyze the power consumption of the refrigerator during a 24 hour period, and from this analysis, to determine the time of day and period(s) of time that will be most efficient for the initiation of a defrost cycle. The system of the '692 patent utilizes an external current sensor to monitor the operation of the refrigerator to determine, via a complex algorithm, the time of day. See, for example, col. 7 of the '692 patent, lines 36-62. Thus, the '692 patent creates and uses a predefined 24 hour energy usage model, wherein the defrost timing is adjusted on the basis of a best fit match to this preprogrammed pattern. However, such a pattern is fixed and non-adaptive to operation in an environment like an office or family, and thus, would likely experience seasonal failures. The calculations performed by the system of the '692 patent would require a controller and ADC that provide for a non-trivial price increase of the defrost control unit. Additionally, such a system would be confused by air conditioning changes local to the refrigerator.

What is needed is a refrigerator defrost controller that overcomes the disadvantages of the present refrigerator defrost controllers and which can be implemented without adding a substantial production cost to the appliance.

SUMMARY OF THE INVENTION

It is accordingly an object of this invention to provide a defrost controller for a refrigeration device that schedules a defrost cycle adaptively, in relation to refrigerator usage. The system adaptively moves the defrost cycle to low usage times based on an evaluation of compressor usage in a daily cycle.

Although the invention is illustrated and described herein as embodied in an adaptive defrost controller for a refrigeration device, it is nevertheless not intended to be limited to the details shown, since various modifications and structural changes may be made therein without departing from the spirit of the invention and within the scope and range of equivalents of the claims.

The construction of the invention, however, together with the additional objects and advantages thereof will be best understood from the following description of the specific embodiments when read in connection with the accompanying drawings.

BRIEF DESCRIPTION OF THE DRAWINGS

The present invention is illustrated by way of example, and not by way of limitation, in the figures of the accompanying drawings, in which like reference numerals refer to similar elements and in which.

DETAILED DESCRIPTION OF THE INVENTION

Figure 1:
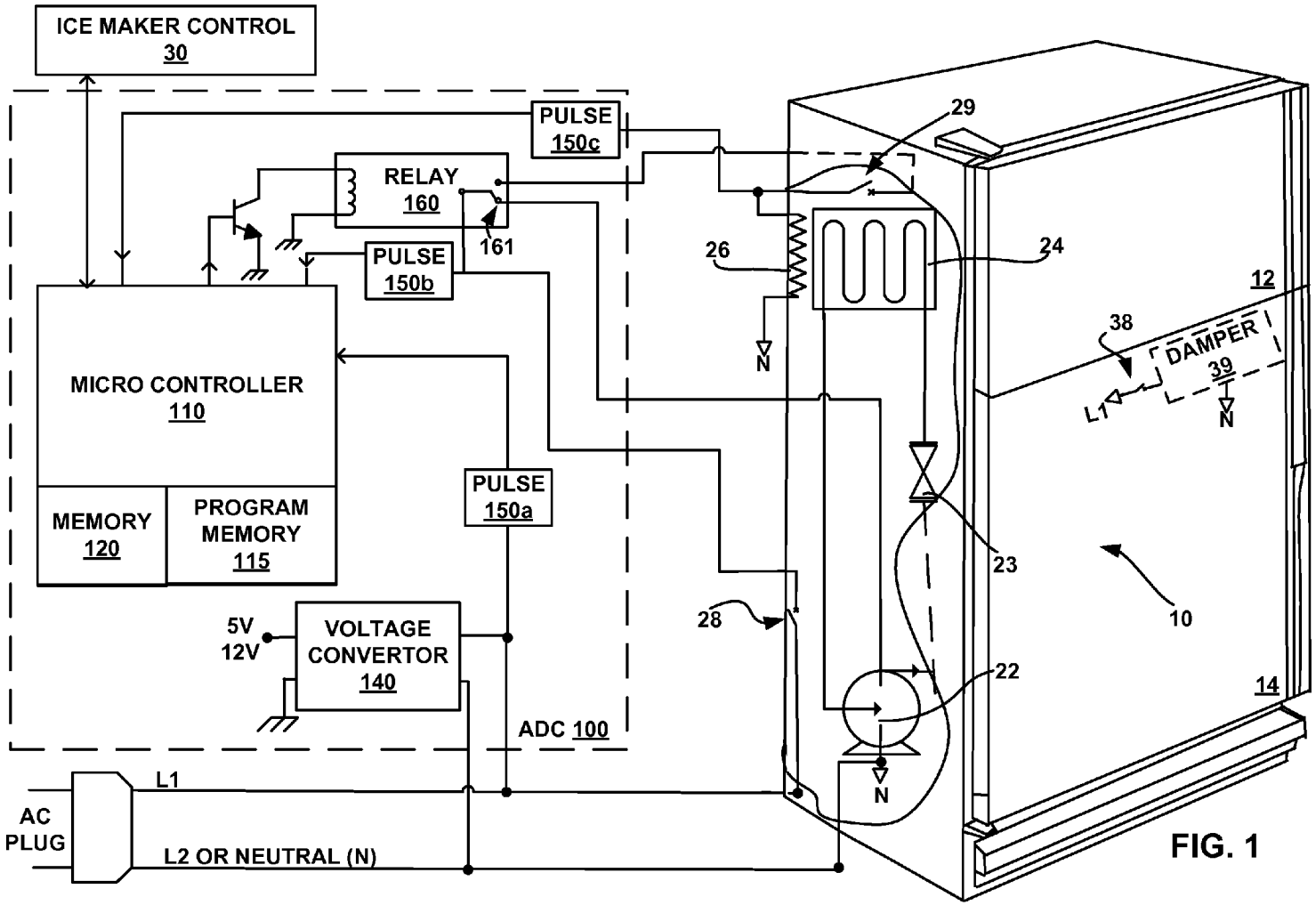
FIG. 1 is a simplified diagram of a refrigerator including an automatic defrost controller in accordance with one particular embodiment of the instant application.

Referring now to FIG. 1, there is shown a refrigerator 10 including a freezer compartment 12 and a fresh food compartment 14. Note that, although the freezer compartment 12 is illustrated in FIG. 1 as a top mounted freezer, this is not meant to be limiting, as other configurations, such as side-by-side or bottom freezer configurations, can be used without departing from the spirit of the presently described invention. It should be understood that, although not shown, the refrigerator 10 includes all of the customary components of a typical refrigerator currently including auto-defrost capabilities, such as an evaporator fan, a condenser fan, a cold control for each of the freezer compartment 12 and the fresh food compartment 14, etc.

Additionally, as illustrated in FIG. 1, the refrigerator 10 includes a small damper door 39 located over an opening between the freezer compartment 12 and the fresh food compartment 14, which is controlled by a thermostat 38. In particular, the thermostat 38 operates to open and close the damper 39 to help control the temperature of the fresh food compartment. Although the configuration will change according to whether a side by side configuration, a top/bottom configuration or a bottom/top configuration is used, the instant top/bottom configuration shown in FIG. 1 includes the damper door over an opening located in one corner of freezer compartment. A second small opening between the freezer compartment and the fresh food compartment is located in another corner of the freezer compartment. When the damper door 39 is opened by the thermostat 38, cold air flows down from the freezer compartment into the fresh food compartment, while warm air from the fresh food compartment flows into the freezer compartment. Although many configurations exist for performing this heat exchange between the freezer and fresh food compartments, it should be understood that this is a common control system found in typical refrigerator. Note that, although described in connection with the particular "freezer on top" configuration shown in FIG. 1, it would be understood how to adapt the configuration to another type of freezer arrangement. For example, it should be understood that for a "bottom freezer" configuration, the freezer compartment will additionally require a fan to move the cool air from the freezer compartment 12 into the fresh food compartment 14.

Referring back to FIG. 1, the refrigerator 10 includes a conventional refrigeration system including a compressor 22 powered by a source of AC power (represented by the AC PLUG). When activated, the compressor 22 compresses the refrigerant contained in a tube and passes it through the expansion valve 23, to the evaporator 24. From the evaporator 24, the now-cooled refrigerant is recycled into the compressor and the cycle is repeated so long as the compressor is active. Actuation of the compressor is controlled by the cold controls for the freezer compartment 12 and the fresh food compartment 14, which are set by a user to a desired temperature or cooling level for each compartment 12, 14. Although a digital cold control can be used, in the most typical implementation the cold controls are made up of an electromechanical device including a knob (set to a desired level by a user) and a thermocouple or thermostat 28. The thermocouple or thermostat 28 controls the actuation of the compressor 22 by disconnecting the source of AC power from the compressor 22 when the desired temperature in the freezer compartment 12 and/or the fresh food compartment 14 has been achieved. In addition to the thermostat 28, the refrigerator of FIG. 1 additionally includes a "defrost terminator" 29 used to signal the end of a defrost cycle. For example, in one particular embodiment of the invention, the defrost terminator is a small bimetal switch that is clipped to the coils of the evaporator coils 24 in series with the defrost heater 26. The defrost terminator 29 operates to signal the microcontroller 110 to stop the current defrost cycle when the coils of the evaporator 26 reach a predetermined temperature, usually just above freezing. The exact temperature for termination of the defrost cycle is based on the particular refrigerator. However, in one preferred embodiment, the defrost terminator 29 operates to stop the defrost cycle when the coils of the evaporator reach 35° F.

Although illustrated as a single thermostat located near the compressor for simplicity, the thermostat 28 of FIG. 1 actually represents two separate thermostats 28, one for the fresh food compartment 14 and the other for the freezer compartment 12. It is understood that each of the thermostats 28 would be more appropriately positioned proximal to the particular compartment 12, 14 of the refrigerator 10 being monitored. In one particular embodiment, the thermostats 28 are electromechanical devices, such as those including a liquid filled tube and bellows arrangement as is typical with present refrigerators. The advantage to such an electromechanical device is that the microcontroller 110 of the Adaptive Defrost Controller or ADC 100 need not be complicated by also controlling the temperature sensing requirements for the refrigerator. This helps to maintain the low cost of the ADC 100, as is particularly desired in connection with the instant application. Note however, this is not meant to be limiting, as the microcontroller of the ADC 100 can also be selected so as to be capable of, and can be programmed to, monitor the temperature of the compartments 12, 14 and activate the compressor 22, when necessary. Note that, although the microcontroller 110 is described herein as a low cost microcontroller 110, other processing devices can be used to perform the functions of the microcontroller 110. For example, in a refrigeration device including a microprocessor, that microprocessor can be programmed to perform the functions described herein in connection with the microcontroller 110, without departing from the spirit of the present invention.

Referring back to FIG. 1, the present preferred embodiment of the refrigerator 10 additionally includes an Adaptive Defrost Controller or ADC 100 that periodically initiates a "defrost cycle", which activates a heater 26 to melt any ice that has formed on the evaporator 22. As discussed hereinabove, the operation of such a defrost cycle consumes a lot of power and can cause the refrigerator's compressor to run for a longer than normal period to return the appliance to its desired internal temperature.

It has also been found that, in addition to consuming a higher than average amount of energy, the performance of a defrost cycle on a refrigerator including a freezer compartment increases the temperature in the freezer compartment. Although still frozen, foods such as ice cream are not at their best immediately following the performance of a defrost cycle. Rather, such frozen foods tend to be softer than desired until after the freezer compartment has recovered (i.e., returned to the desired temperature). By moving the operation of the defrost cycle to a period when the refrigerator is not normally used, the instant invention additionally improves the quality of the food being consumed (for example, ice cream) by permitting the food to recover before being eaten.

As such, it is desirable to adaptively move at least a majority of these high energy defrost cycles to time periods when the refrigerator is not customarily used by the consumer, and/or when the electrical power "grid" has the lowest loading and lowest available energy cost, for example, at nighttime. It is additionally desirable to provide an ADC 100 that is relatively inexpensive to produce. In one particular embodiment of the invention, the ADC 100 utilizes all of the hardware components of current conventional ADCs, but also includes additional software/firmware program instructions that create the adaptive control of the defrost cycle. As will be seen from the following description, the ADC 100 of the instant embodiment is able to adaptively provide defrost cycles at low usage/energy cost time periods without the need for "external" information being provided by sensors external to the refrigerator, thus significantly reducing the cost of implementing such an ADC 100, and without any external signals, for example, from a "smart grid" implementation.

The ADC 100 of the instant embodiment includes a microcontroller 110 that is particularly programmed to perform a specific method by executing program instructions stored in the program memory 115. In particular, the microcontroller 110 of the ADC 100 is programmed to adaptively form a profile of compressor run times over a 24 hour cycle, and from the profile, determine the low usage and/or nighttime portions of the cycle. The profile can be adaptively refined over a series of days, weeks, months and/or continuously, to better refine the profile and to accommodate seasonal changes.

In order to create a profile from which to schedule the defrost cycles of a refrigerator, certain baseline characteristics for refrigerators must be recognized. In particular, it should be understood that current refrigerators defrost in different ways. Some defrost more than once a day, while others defrost once every few days. Additionally, refrigerator compressor run cycles can be somewhat less than an hour or can be longer. Two well know external effects on compressor run time are: a) external ambient temperature; and b) use, such as by opening and closing the door allowing warm air exchanged and/or adding warm food.

In modeling a typical ambient temperature profile, it is recognized that warmer ambient temperatures typically occur during the day. During heating season the ambient profile is flat or, more typically, cooler at night due to the use of setback thermostats. During mild weather (i.e., while windows are open) the daytime is naturally warmer. During cooling season, most homes will set the air conditioning to turn on at higher temperatures during the day, thus making the home warmer at times when people are not present. In an office setting, however, it is possible to invert this temperature profile. In a case where the air conditioning is only on during the day, it is likely that the refrigerator is also only used during the day. In this last case, the daytime use will typically override the temperature profile inversion.

There are certain cases where it is difficult to determine the daytime/nighttime cycle from the ambient temperature profile. For example, in a household where the ambient temperature is evenly maintained all day or in a case where the morning high use period and evening high use period are 11-12 hours apart. In such cases, a profile can still be derived showing high usage time periods and such periods can be avoided for better food quality. In these cases, the two low use periods can be compared and the lower of the two periods determined, so that defrost can be scheduled in that period. If no determination can be made, the defrost cycle could be scheduled so as to alternate between the different time periods, so as to avoid always scheduling in a high energy usage time.

Many refrigerator makers are moving towards using larger electronic controls for improving ADC performance. However, it is a goal of the present invention to provide an improved refrigerator while still using a low cost ADC. Rather, instead of using a larger, more expensive electronic control for ADC, the instant invention uses a conventional, low cost ADC that has been programmed to derive usage profiles that can be used to move defrost cycles to low usage times and/or nighttime, to take advantage of low energy cost times and to improve the quality of foods consumed from the freezer (i.e., thus avoiding a "soft ice cream" scenario). In one particular preferred invention, the ADC 100 of the instant application uses an inexpensive 1k, 8-bit, 8-pin microcontroller for the microcontroller 110. As shown in FIG. 1, the microcontroller 110 can be integrated into a single package with the program memory 115 and with additional memory 120. Additionally, in the instant embodiment, the ADC can include a minimum of one relay 160 that controls defrost. This relay 160 can be used to provide the main control coming out of ADC 100. In particular, when the thermostat 28 is closed, AC power is provided to the compressor 24 via the relay 160 and the normally closed contact 161 thereof. Thus, switching of the relay 160 provides power to the compressor 24 from the ADC controller 100. Additionally, in accordance with one particular embodiment of the instant invention, under control of the algorithm stored in the program memory 115, the ADC 100 also switches the relay 160 run the defrost heater after a predetermined amount of compressor run time. In one particular embodiment, the relay 160 is switched after 20 hours of compressor run time so that the next call to the compressor actually operates the defrost heater 26 instead of the compressor 24. Note that the 20 hour runtime number is adjusted every cycle based on many factors including, importantly, the time it takes to defrost.

The ADC 100 produced in this way would have few connections and a small footprint (i.e., 4 inch by 4 inch PCB). Thus, in the instant embodiment of the invention described in connection with FIG. 1, implementation of the instant invention would not substantially change the physical hardware requirement of the ADC 100 from that of currently available ADCs. At most, the ADC cost would be increased by a few pennies by the need for a slightly larger program memory 115 to hold the additional code required to program the existing microcontroller 110 to perform in accordance with the instant invention. This is a departure from the systems of the prior art that seek to improve the efficiency of the ADC by adding complex algorithms that require much more expensive controllers, external sensors and/or additional connections to devices not presently a part of current conventional ADC implementations.

Figure 2:
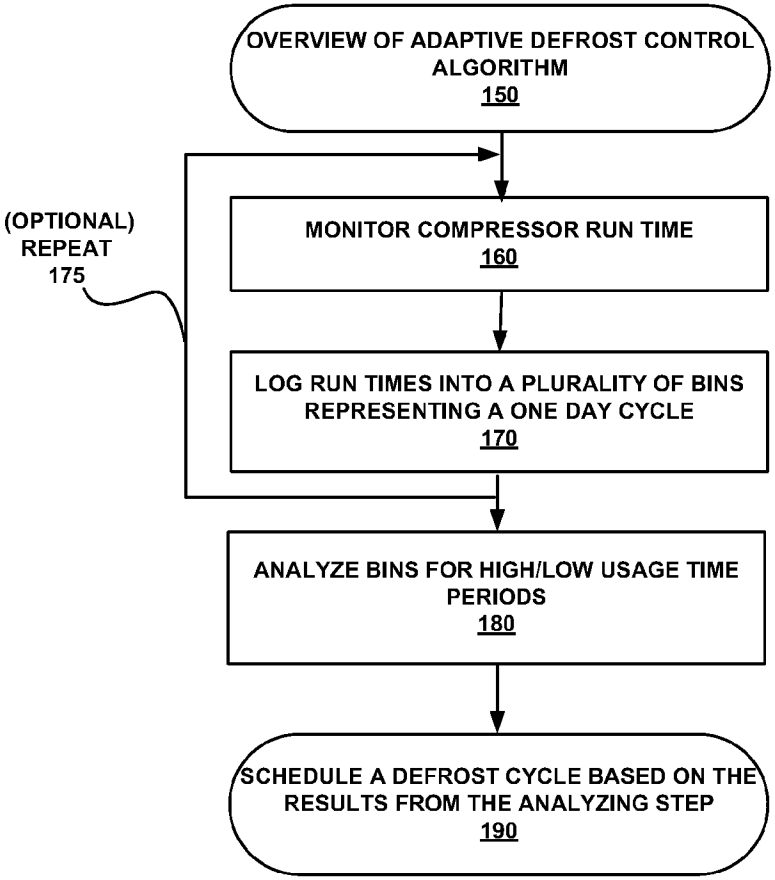
FIG. 2 is a flow chart of a generalized process for the algorithm of one particular embodiment of the instant invention.

Referring now to FIGS. 1-2, there will be described one particular embodiment of a process implemented by the microcontroller 110 executing the algorithm of the invention stored in program memory 115. In the present embodiment, the microcontroller 110 and relay 160 receive a DC voltage from the voltage convertor 140, which is connected to the AC line AC PLUG and which develops from the AC line a DC voltage (typically 5V or 12V) used to run the microcontroller 110 and the relay 160.

The microcontroller 110 additionally receives a regular period timing signal input that causes the microcontroller 110 to operate on a regular basis, and which the microcontroller accumulates to form a "clock". In one particular embodiment of the invention, the microcontroller 110 tracks time by counting AC line zero crosses, which relate directly to time. In the instant embodiment of the ADC 100 shown in FIG. 1, a pulse circuit 150 (i.e., 150*a*, 150*b*, 150*c* of FIG. 1) is used to provide a train of regular timing "tics" to the microcontroller 110. More particularly, the pulse circuit 150 reduces the high AC voltage waveform from AC PLUG to a low voltage pulse, typically between 0 to 5V. Additionally, the pulse circuit 150 offers protection form noise and voltage spikes.

As can be seen from FIG. 1, the pulse circuit 150 is used in three places in the circuit of the ADC 100. See, for example, 150*a*, 150*b* and 150*c* of FIG. 1. First, the pulse circuit 150*a* is connected between the AC line L1 of the AC PLUG and the microcontroller 110. This pulse circuit 150*a* provides the microcontroller 110 with a pulse train at the AC line frequency, for example, at 60 Hz in the United States and other 120V/60 Hz countries, and at 50 Hz in Europe. It is very common in AC connected devices to derive a "clock" from these pulses. In the United States, the AC line frequency is maintained very accurately at 60 Hz, resulting in a very accurate clock being made. As such, the microcontroller 110 uses the pulse train generated by the pulse circuit 150*a* to maintain and update a "clock". See, for example, step 230 of FIG. 4A.

A second pulse circuit 150*b* provides feedback to the microcontroller 110 from the thermostat 28. Similarly, a third pulse circuit 150*c* provides feedback to the microcontroller 110 from a defrost terminator 29, which operates to inform the microcontroller to terminate the defrost cycle. Each of the pulse circuits 150*a*, 150*b* and 150*c* provides the microcontroller 110 with a low voltage pulse stream at the AC line frequency when operating. For example, although the pulse circuit 150*a* provides a constant stream of pulses while AC is present, the pulse circuits 150*b* and 150*c* only provide a pulse stream to the microprocessor when the thermostat and defrost terminator are closed, respectively. In operation the pulse streams provided by the pulse circuits 150*b* and 150*c* permit the microcontroller 110 to keep track of the run times of the compressor 24 and defrost heater 26, respectively.

Upon initialization of the ADC 100 and/or periodically thereafter, the microcontroller 110 monitors the run times of the compressor 24. Step 160. In the present preferred embodiment, the microcontroller 110 accumulates the pulses provided by the pulse circuit 150*b* to create a count of the run time of the compressor. However, this is not meant to be limiting, as other ways of monitoring run time can be used. For example, run times can also be monitored by registering at least one of: a relay or switch operation (such as the closing of the switch in thermostat 28); a detected voltage change; a detected increased current draw; and/or based on the monitored temperature in the freezer compartment and/or the fresh food compartment, if desired. It should be understood that other ways of detecting and monitoring the runtime of the compressor 24 can be used without departing from the spirit of the invention.

Compressor run times observed by the microcontroller 110 are logged into bins based on their occurrence and duration. In particular, using the period timing signal input, the microcontroller 110 defines a plurality of bins representing a one day cycle of operation of the compressor 24 of the refrigerator 10. For example, if it is desired to have one "bin" for each hour of a twenty-four hour period, then the microcomputer 110 will define 24 bins per daily cycle. Note that this example is not meant to be limiting, as "bins" can be of any desired length and still be in keeping with the spirit of the invention. For example, in one particular embodiment of the invention, a daily cycle is made up of six bins, each having a four hour duration. In another particular embodiment, from 10 bins to 32 bins can be used per twenty-four hour cycle (i.e., so long as the number of bins of a particular duration add up to cover a cycle of one day). During operation of the ADC through a one day cycle, a pointer is advanced to point to the bin in which data is currently being logged. Compressor activity is logged, in real-time, to the bin to which the pointer is currently pointing. Step 170.

Figure 3:
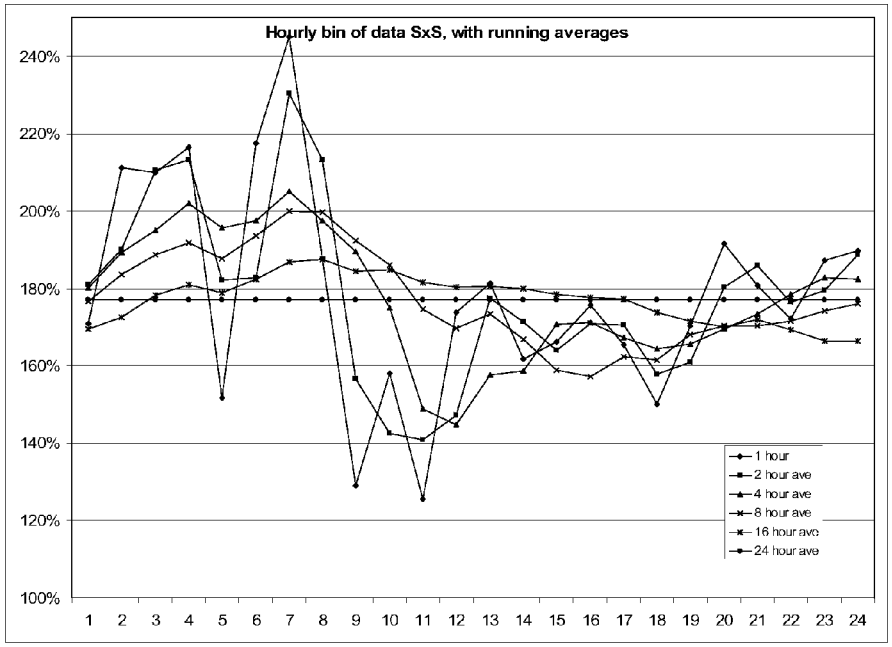
FIG. 3 is a graph showing the running averages for compressor usage vs. bin time in a twenty-four hour cycle, wherein the high compressor activity times (day) are easily distinguishable from the low compressor activity times (night)

At some point in its operation, the ADC 100 will analyze the stored data to develop a profile for compressor activity vs. time (i.e., bin number). Step 180. Note that this profile can be developed by analyzing the recorded data relating to the operation of the compressor 24 over a period of a day, a week, a month, continuously, or even another time interval, as desired. In one particular preferred embodiment, the ADC 100 will develop a profile for the compressor run times by analyzing 5-7 days worth of collected data. Typically, because of the above-discussed correlation between ambient temperatures (i.e., higher during the day) and compressor runtime (i.e., compressor runs more with higher ambient temperature and usage), day and night can be particularly distinguished from one another. See, for example, the graph of FIG. 3 showing the running averages for compressor usage vs. bin time in a twenty-four hour cycle for a particular refrigerator/freezer device located in an office lunchroom. As can be seen from FIG. 3, in the instant example, the high compressor activity times (day) are easily distinguishable from the low compressor activity times (night).

As such, after analyzing the data gathered over a predetermined number of cycles (step 175), a pattern is likely to emerge showing bins having high compressor activity and, correspondingly, bins having low compressor activity. The system of the instant invention uses the data gathered on compressor run times and off times to schedule the defrost during the nighttime/low usage cycle (i.e., non-peak energy times on an electrical grid).

In particular, the bins of compressor operation are averaged and these averaged values are used to produce a compressor operating time trace. The microcontroller 110 operates to search the trace to find a group of minimal values of compressor operation. The middle of this group is then used as a target time for scheduling a defrost operation. Step 190.

Figure 4A:
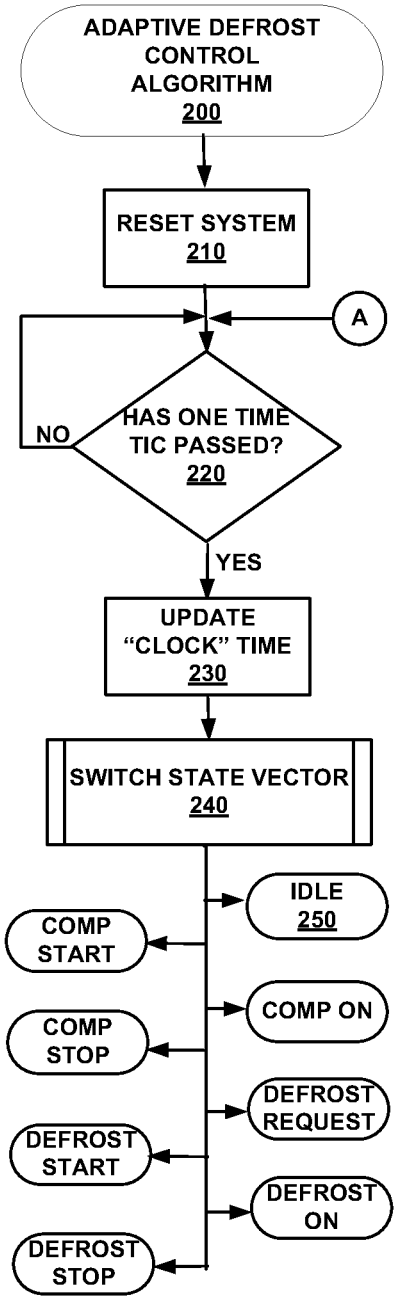
FIGS. 4A and 4B are a flow chart illustrating the algorithm of another particular embodiment of the instant invention.
Figure 4B:
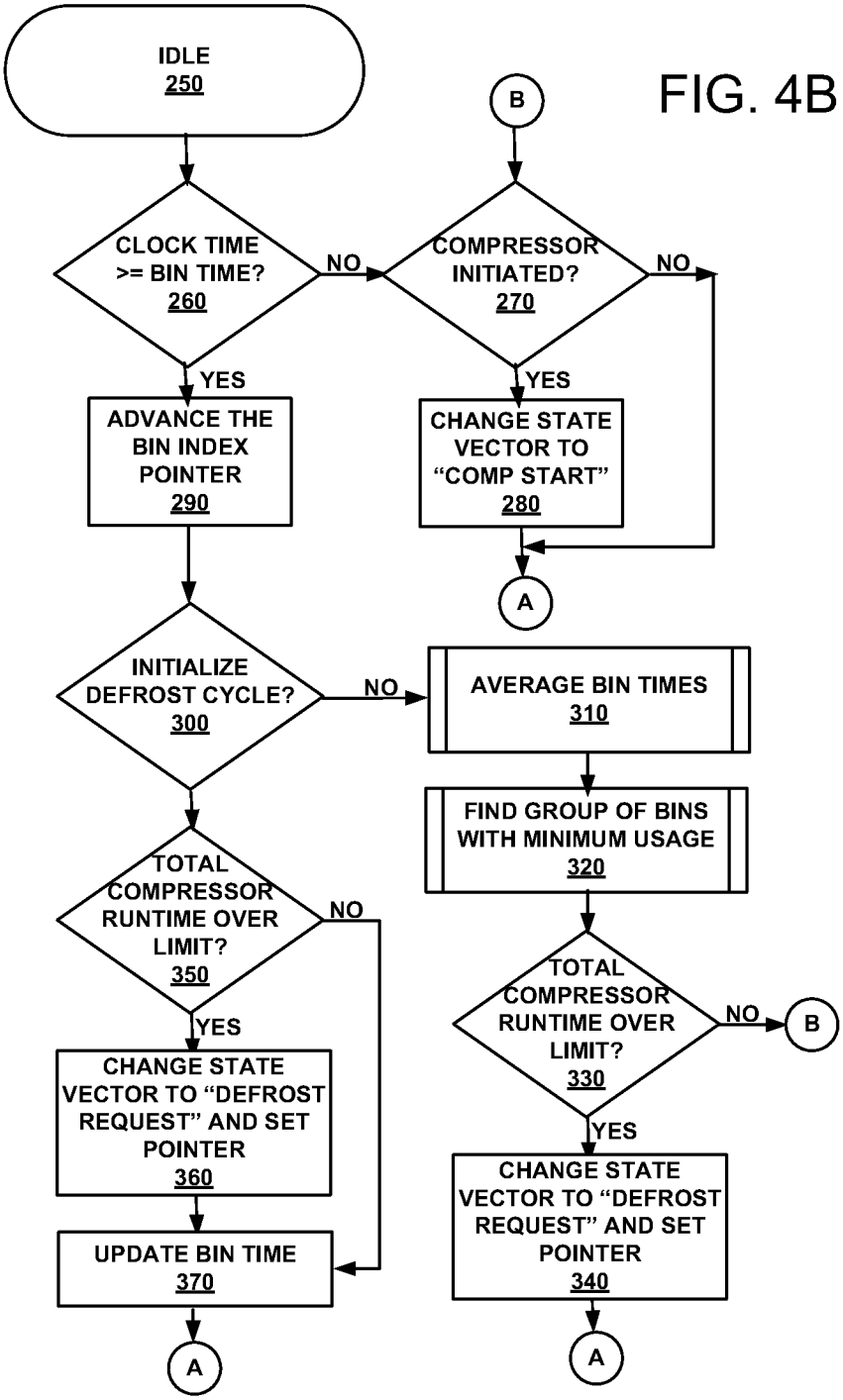

Referring now to FIGS. 1, 4A and 4B, there will be described in more detail a method 200 of operating an ADC in accordance with one particular embodiment of the instant invention. As noted above, conventional ADC hardware can be used to implement the present ADC 100. However, the microcontroller 110 will execute an algorithm in accordance with the following description. More particularly, the microcontroller 110, uses a received periodic timer input to advance a pointer through a fixed set of time bins. In the present embodiment, these bins together cover a 24 hour cycle. The progression of the indexing pointer through the set of time bins is cyclical, starting over again as soon as it completes.

More particularly, at initialization of the ADC 100, the system is reset and all bins are cleared. Step 210. Also at this time the bin index, runtime count and "clock" count are set to zero and the state vector is set to "idle". Upon receiving a clock "tic" from the timing signal source 125 (step 220), the stored "clock" time is updated (i.e., the clock count is advanced by one "tic"). Step 230.

Under control of the stored algorithm, the microcontroller 110 monitors external requests to run the compressor 24. The microcontroller 110 uses these requests, along with an internal count of the operating time, to log the compressor operation into the time bins indicated by the indexing pointer. As such, upon detecting a request to change state, the microcontroller 110 updates the state vector of the system. Step 240. For example, the state vector is updated to reflect whether the system is in an idle state; whether the compressor has started, is on, or has stopped; whether a defrost request has been initiated; and whether the defrost cycle has started, is on, or has stopped. See, for example, FIG. 4A.

The method of the instant embodiment takes advantage of the system idle time to analyze and/or process the collected data. For example, referring more particularly to FIG. 4B, when the system state vector is set to "IDLE" (step 250), the algorithm first checks whether the tic count "clock" time is greater than or equal to the bin time. Step 260. If not, the system checks to see whether the compressor has been initiated. Step 270. If the compressor has not been initiated, the state vector remains in the idle state and the algorithm checks whether a time tic has passed (step 220 of FIG. 4A). If the compressor state has changed, the algorithm updates the state vector to reflect that the compressor 24 has started (step 280) before jumping to step 220 of FIG. 4A.

If the microcontroller 110 determines in step 260 that the tic count "clock" time is greater than or equal to the bin time, the bin index pointer is advanced to point to the next bin (step 290) and the microcontroller checks whether to initialize the defrost cycle (step 300). If no defrost cycle is indicated, the algorithm initiates the process of averaging the recorded data stored in the bins. Step 310. For example, in one particular embodiment of the invention, the bins of compressor operation are averaged using a low pass IIR filter or a low pass FIR filter. These averaged values are used to produce a compressor operating time trace. This trace is analyzed to find a bin group exhibiting a minimum of compressor operation values. Step 320. The middle of this group is used as a target time for scheduling a defrost operation and a defrost pointer can be set to indicate this target time. Once the indexing pointer reaches the target bin (i.e., target time), a defrost cycle is scheduled in place of the next requested compressor cycle.

In one particular embodiment of the invention, the compressor run time is also accumulated to determine how much total compressor operation has occurred. This accumulation can be compared to an operational limit for a defrost cycle and used to schedule a defrost cycle only after the total runtime is equal to or greater than the operational limit. Step 330. In such a case, the defrost cycle would be scheduled for the next time the target bin (i.e., identified nighttime/low usage bin) is reached after the operational limit has been met and the defrost pointer is set to point to the previously determined target time. Step 340.

If, in step 300 a defrost cycle initialization was indicated, the microcontroller 110 compares the total accumulated compressor time to the operational limit (step 350), and if the operational limit is exceeded, sets the state vector to indicate a defrost request and sets the indexing pointer for the pointer the target bin (step 360). The microprocessor updates the bin time (step 370) before returning to step 220 of FIG. 4A.

Note that other factors can also be used to influence the scheduling of a defrost operation. For example, if desired, instead of compressor run times, or in addition thereto, the system of the instant invention can use temperature profiles derived from temperatures in the freezer compartment (according to the operation of the thermostat 28) to schedule a defrost at night or other times of low usage and/or non-peak energy times. Similarly, the ADC 100 may, optionally, be provided with a circuit that detects door openings and closings, indicative of usage, to provide even further data in developing a high usage profile for the ADC, or, if available, such data can be used as a backup to confirm the data based on compressor run times and/or freezer chamber temperatures. Additionally, it is possible that the maximum voltage of the AC line in (18 of FIG. 1) occurs at night. As such, the voltage level of the AC line in can be analyzed over a period of days to locate the maximum voltage levels (indicative of nighttime) and the microcontroller can schedule the defrost cycles at those times.

As noted above, once the timing pointer reaches the defrost target bin, as indicated by the defrost pointer, a defrost cycle is scheduled in place of the next requested compressor cycle. In one particular embodiment of the invention, the duration of the defrost cycle is logged and compared to the average defrost cycle. The delay until the next defrost request is adjusted based upon this comparison.

If desired, the data collected in the bins can be analyzed and used to influence other operations of the refrigerator. For example, the data regarding low usage times can be used by the microcontroller 110 to coordinate with an external ice maker control 30 to provide greater efficiency for the refrigerator, as making ice has become a major energy use in refrigerators. Additionally, the stored data can be made available to diagnostic functions of the refrigerator. For example, if a change to the long term average is detected, the microcontroller can signal to check that the door is closed (i.e., if the ratio stays below the line for 24 hours).

As can be seen from the foregoing, the operation of the entire system is stable and should adapt to running defrost cycles during the minimum usage periods of the refrigeration system. These advantages are provided at little to no additional cost over the conventional ADC design, requiring, at most a slightly larger program storage memory. For example, it is estimated that to implement an algorithm in accordance with one particular embodiment of the invention will require an additional 256 bytes of flash memory (program storage) and an additional 72 bytes of RAM. Additionally, the system of the invention does not require any additional signals to be obtained than are already present in conventional ADCs. In fact, it may be possible to simplify the connections to the ADC by utilizing only temperature to indicate compressor operation. By simplifying such connections, it may be possible to move the ADC to the back of the refrigerator, near the evaporator, thus allowing for more usable space in the fresh food compartment of the refrigerator.

The system of the instant invention advantageously moves the defrost cycle to low usage times of the refrigerator without requiring external sensors or clocks to make a determination of those times. As a result, a refrigerator including the ADC of the instant invention can provide better quality of foods at the refrigerator's prime usage time. Moving the defrost to low usage times also improves the temperature stability of the fresh food compartment by moving defrosts (that may raise the temperature in that compartment) to low refrigerator traffic times.

Although the invention is illustrated and described herein as embodied in an adaptive defrost controller for a refrigeration device, it is nevertheless not intended to be limited to only these details shown. For example, the method of the invention can be implemented in refrigeration systems other than the ADC. New designs are incorporating a full machine electronic control system. The method here can easily be adapted for use in larger control systems. As can be seen, various modifications and structural changes may be made therein without departing from the spirit of the invention and within the scope and range of equivalents of the claims.

What is claimed is:

1. An adaptive defrost controller, comprising:

a processor configured to:

define a plurality of data bins representing a cyclically recurring pre-defined time period of operation of a compressor, each bin associated with a portion of the cyclically recurring pre-defined time period;

monitor compressor run times over the cyclically recurring pre-defined time period;

log, over time, data of the detected compressor run times into bins associated with the particular portions of the cyclically recurring pre-defined time period in which the compressor run times were detected;

analyze the data logged into the bins to detect bins recording less compressor activity during the cyclically recurring pre-defined time period than other bins of the cyclically recurring pre-defined time period; and schedule a defrost cycle based on the results of the analyzed data.

2. The adaptive defrost controller of claim 1, wherein the processor is a microcontroller.

3. The adaptive defrost controller of claim 1, wherein said processor monitors compressor run times by monitoring at least one of:

a relay or switch operation; a detected voltage change;

a detected increased current draw; and a temperature in at least one of a fresh food compartment and a freezer compartment.

4. The adaptive defrost controller of claim 3, wherein the adaptive defrost controller is part of a refrigeration device, and said processor monitors compressor run times by monitoring only a temperature of at least one of a fresh food compartment and a freezer compartment of the refrigeration device.

5. The adaptive defrost controller of claim 1, wherein said processor is additionally configured to average the data logged into the bins prior to analyzing the data.

6. The adaptive defrost controller of claim 1, wherein the data is averaged using a low pass a infinite impulse response (IIR) filter or finite impulse response (FIR) filter.

7. The adaptive defrost controller of claim 1, wherein said defrost cycle is scheduled to occur during a targeted time period in a bin showing a past history of less compressor activity during the cyclically recurring pre-defined time period than other bins of the cyclically recurring pre-defined time period.

8. The adaptive defrost controller of claim 7, wherein said defrost cycle is started during the targeted time period instead of a requested compressor operation.

9. The adaptive defrost controller of claim 7, wherein the processor is additionally configured to accumulate a count of compressor run times during the cyclically recurring pre-defined time period, compare, in response to a defrost request, the accumulated count of compressor run times to a threshold, and if the threshold is not met, not to schedule a defrost cycle, but if the threshold has been met or exceeded, to schedule a defrost cycle during the next targeted time period.

10. The adaptive defrost controller of claim 7, wherein the adaptive defrost controller is part of a refrigeration device, and another control system of the refrigeration device is signaled to start at the same time as said scheduled defrost cycle.

11. The adaptive defrost controller of claim 10, wherein the another control system is an ice maker control.

12. The adaptive defrost controller of claim 1, wherein the adaptive defrost controller is part of a refrigeration device, and the analyzed data is additionally used by a diagnostic system of the refrigeration device.

13. A method of performing a defrost cycle in a refrigeration device including an adaptive defrost controller, comprising the steps of:

defining a plurality of data bins representing a cyclically recurring pre-defined time period of operation of a compressor, each bin associated with a portion of the cyclically recurring pre-defined time period;

monitoring compressor run times over the cyclically recurring pre-defined time period;

over time, logging data of the detected compressor run times into bins associated with the particular portions of the cyclically recurring pre-defined time period in which the compressor run times were detected;

analyzing the bins to detect bins recording less compressor activity during the cyclically recurring pre-defined time period than other bins of the cyclically recurring pre-defined time period;

scheduling a defrost cycle based on the results of the analyzing step; and performing a defrost operation.

14. The method of claim 13, wherein at least the monitoring, logging and analyzing steps are performed by a microcontroller.

15. The method of claim 13, wherein the monitoring step monitors compressor run times by monitoring at least one of:

a relay or switch operation;

a detected voltage change;

a detected increased current draw; and a temperature in at least one of a fresh food compartment and a freezer compartment.

16. The method of claim 13, further comprising the step of averaging the data logged into the bins prior to the analyzing step.

17. The method of claim 16, wherein the averaging step is performed using a low pass IIR or FIR filter.

18. The method of claim 13, wherein the defrost cycle is scheduled to occur during a targeted time period in a bin showing a past history of less compressor activity during the cyclically recurring pre-defined time period than other bins of the cyclically recurring pre-defined time period.

19. The method of claim 18, further comprising the steps of:

accumulating a count of compressor run times during the cyclically recurring pre-defined time period;

comparing, in response to a defrost request, the accumulated count of compressor run times to a threshold; and if the threshold is not met, not scheduling the defrost cycle at that time; and if the threshold has been met or exceeded, scheduling the defrost cycle during the next targeted time period.

20. The method of claim 13, wherein the defrost operation is started during the targeted time period instead of a requested compressor operation.

21. A computer program stored on a computer readable memory device, and executable by a processor, execution of the computer program causing the processor to perform the steps of:

monitoring compressor run times over a cyclically recurring pre-defined time period;

defining a plurality of data bins representing the cyclically recurring pre-defined time period of operation of a compressor, each bin associated with a portion of the cyclically recurring pre-defined time period;

over time, logging data of the detected compressor run times into bins associated with the particular portions of the cyclically recurring pre-defined time period in which the compressor run times were detected;

analyzing the bins to detect bins recording less compressor activity during the cyclically recurring pre-defined time period than other bins of the cyclically recurring pre-defined time period; and scheduling a defrost cycle based on the results of the analyzing step.

22. The computer program of claim 21, wherein the monitoring step monitors compressor run times by monitoring at least one of:

a relay or switch operation;

a detected voltage change; a detected increased current draw; and a temperature in at least one of a fresh food compartment and a freezer compartment.

23. The computer program of claim 21, wherein said computer program causes the processor to average the data logged into the bins prior to the analyzing step.

24. The computer program of claim 21, wherein the defrost cycle is scheduled to occur during a targeted time period in a bin showing a past history of less compressor activity during the cyclically recurring pre-defined time period than other bins of the cyclically recurring pre-defined time period.

25. The computer program of claim 21, which, when executed by a processor, causes the processor to perform the additional steps of:

accumulating a count of compressor run times during the cyclically recurring pre-defined time period;

comparing, in response to a defrost request, the accumulated count of compressor run times to a threshold; and if the threshold is not met, not scheduling the defrost cycle at that time; and if the threshold has been met or exceeded, scheduling the defrost cycle during the next targeted time period.

* * * * *